US005772465A

United States Patent [19]

Hwang et al.

[11] Patent Number: 5,772,465

[45] Date of Patent: Jun. 30, 1998

[54] CONNECTOR STRUCTURE ACCOMMODATING DE-TWISTED WIRE PAIRS

[76] Inventors: Wayne Hwang; Richard Hai-Tau Hwang, both of 2422 Southslope Way, West Linn, Oreg. 97068

[21] Appl. No.: 749,653

[22] Filed: Nov. 15, 1996

[51] Int. Cl.[6] ..... H01R 4/24

[52] U.S. Cl. ..... 439/418; 439/101; 439/607

[58] Field of Search ..... 439/418, 425, 439/607, 610, 676, 354, 941, 344, 404, 497, 101

[56] References Cited

U.S. PATENT DOCUMENTS

| | | | |
|---|---|---|---|
| 3,954,320 | 5/1976 | Hardesty | 439/418 |
| 4,424,403 | 1/1984 | Bogese, II | 439/497 |
| 5,562,475 | 10/1996 | Kern, Jr. et al. | 439/344 |

*Primary Examiner*—Gary F. Paumen
*Assistant Examiner*—Tho Dac Ta
*Attorney, Agent, or Firm*—McDermott, Will & Emery

[57] ABSTRACT

A connector includes a body having an interior space for receiving de-twisted wires of a cable therein. The body has a plurality of channels for the insertion of the wires. The channels have openings formed on a front end face of the body so as to allow a portion of the wires to expose outside the front end face of the body to be pulled by an operator's hand to the desired position. The body also has a plurality of slots each receiving a metal contact therein. The metal contacts have piercing ends to penetrate into the wires for holding them in position. The exposed portions of wires are then cut off after being held by the metal contacts and a retainer for retaining the connector to a counterpart connector is removably attached to the body. The body has an open bottom defined by two opposite side walls, each having a reduced height defined by an arc connecting segment so as to allow the operator's finger to insert therein for temporarily holding the wires in position. The body also has a strip defined by an elongated opening formed thereon to allow a grounding wire of the cable to surround thereon. A metal casing is fit over the body to secure the grounding wire in position and to establish an electrical connection with the grounding wire.

10 Claims, 10 Drawing Sheets

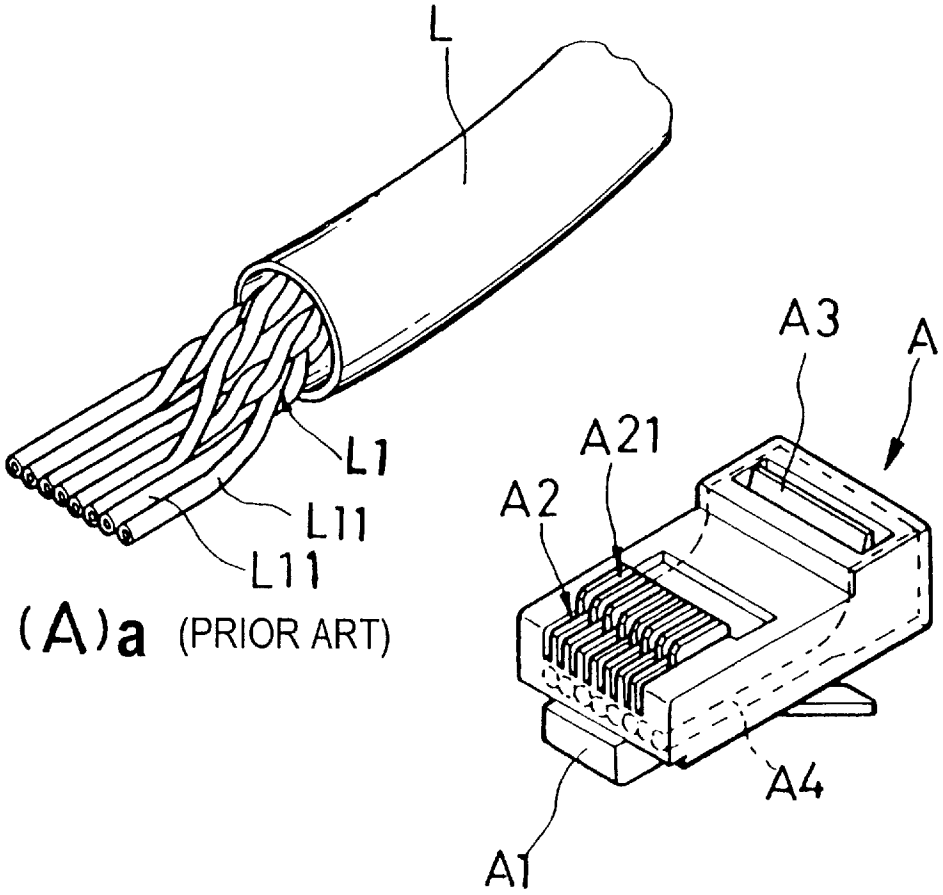
FIG. 2 (A) a (PRIOR ART)
FIG. 2 (A) b (PRIOR ART)

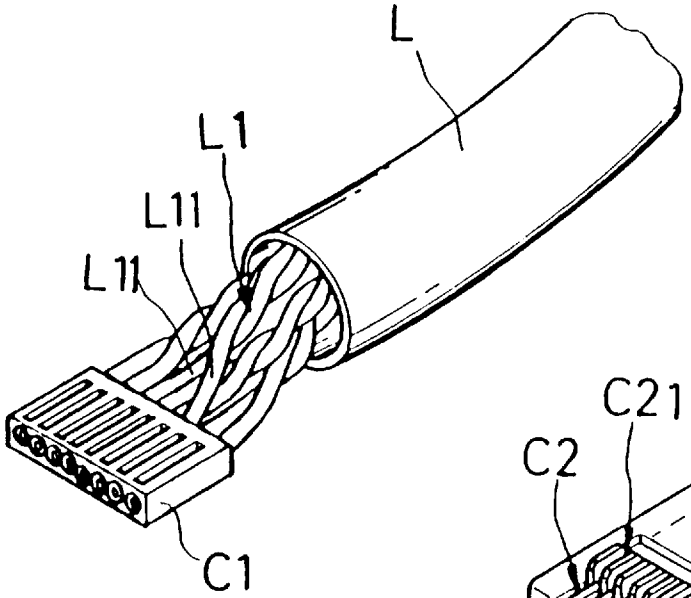
FIG.2(B)a (PRIOR ART)
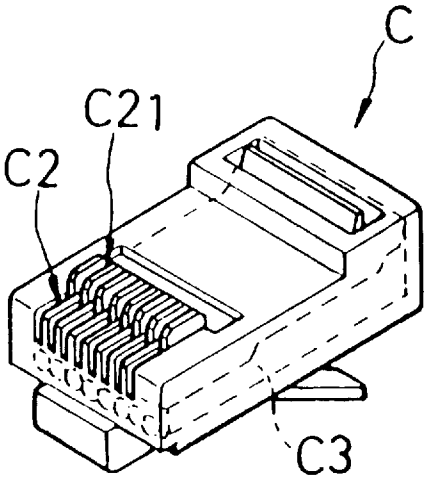
FIG.2(B)b (PRIOR ART)

CONNECTOR STRUCTURE ACCOMMODATING DE-TWISTED WIRE PAIRS

FIELD OF THE INVENTION

The present invention relates to an electrical connector for telecommunication and/or computer system and in particular to a plug connector adapted to be plugged into and engaging a counterpart socket connector for establishing electrical connection therebetween.

DESCRIPTION OF THE RELATED PRIOR ART BACKGROUND

In a telecommunication system, wiring is usually used to connect between for example devices or sub-systems. Usually, the connection is provided by a plug connector and a counterpart socket connector. The socket connector receives and electrically engages the plug connector. Usually, a plug connector has a number of wires mounted thereto. A common configuration is to provide eight (8) wires associated with a single plug connector. The eight wires form a cable enclosed by an outer enclosure which is usually an insulation member with a grounding member, such as a braided net member, interposed therebetween. These wires are arranged very close to each other within the cable for the sake of saving space and being easy to handle.

Due to the development and improvement of the telecommunication technique, the state-of-art telecommunication system now handles signals in a very high frequency. Such a high frequency of signal transmission causes the so called "cross-talking" between closely adjacent wires. To eliminate the "cross-talking" phenomena, the wires are twisted together by every two wires so as to form twisted wire pair which may be also referred to as twisted pair to obtain electrical balance between these wires. Each twist pair, as the name infers, comprises two wires twisted about each other.

There are several different designs of the plug connectors available in the market. All the currently available designs of plug connectors receive the eight wires in a parallel manner so that the twist pairs of the cable have to be de-twisted and re-arranged to be parallel with each other first for mounting to the plug connector. In mounting the wires to the connector, a plurality of conductive spring members are provided on the connector to serve as metal contacts which are usually referred to as "golden plates". The metal contacts are received within slots corresponding to and located above the de-twisted wires and are electrically engageable by the counterpart members of the associated socket connector.

In the conventional designs, the end portions of the eight de-twisted wires are manually inserted into and pushed forward through wire channels formed in the connector body to a desired position located under and thus electrically engageable by the metal contacts. Since the connector itself is very small in size and since the mounting of the wires to the connector, so far, is not automatized, it is a labor- and time-consuming job to mount the wires to the connector and the percentage of flaw product is very high. This is in general due to the fact that the de-twisted wires still possesses certain deformability and may undergo deformation when they are manually pushed to the desired position and then released in order to be secured by the metal contacts so that the securing operation provided by the metal contacts may thus be performed on wires that are not correctly positioned.

FIG. 1A show a prior art design of plug connector. As shown in FIG. 1A, the prior art connector comprises a body A having a movable anchor member A3 for fixing the cable L to the connector body A. FIG. 2A shows a perspective view of the connector body A with the cable L removed therefrom. The connector body A is a hollow member of which the inside structure is illustrated with phantom lines. The connector body A has a plurality of wire channels A4 which are arranged to be parallel and juxtaposing each other for each receiving therein an individual wire L11 which is de-twisted from the twisted pairs L1 forming the cable L.

The connector body A further comprises a plurality of slots A2 formed above and substantially corresponding to the wire channels A4 to receive and retain therein the metal contacts A21. The metal contacts A21 comprise piercing means to penetrate through the outer insulation layer of the wires L11 to establish electrical connection therewith. The metal contacts A21 also serve to hold the de-twisted wires L11 in position within the connector body A.

A retainer member A1 is provided on the connector body A to retain the plug connector in a counterpart socket connector in a releasable manner.

As mentioned above, the de-twisted wires L11 may still undergo certain deformation once they are inserted into the wire channels A2 but have not yet been held by the metal contacts A21. The deformation of the de-twisted wires L11 may cause mis-alignment of the wires within the connector body of the final product of the connector. Further, inserting the wires L11 into the channels A2 must be performed by skilled operators, otherwise some of the wires may not get into the correct channels or even miss the channels.

In FIG. 2B, a different prior art design of the plug connector is shown. A connector of this design comprises a connector body C defining an interior space C3 for receiving the end portions of twisted wire pairs L1 that form the cable L. A wire holder C1 is provided, comprising a plurality of wire channels to receive and hold the end portions of the de-twisted wires L11 of the wire pairs L1. The wire holder C1 is then inserted into the interior space C3 of the connector body C to have the wire channels of the wire holder C1 abutting against the end wall of the connector body C and the wire channels in registration with slots C2 that are formed on the connector body C to receive therein metal contacts C21 so as to allow the metal contacts C21 to extend into the wire channels to establish electrical connection therewith. This design, although facilitating the insertion of the wires L11 into the connector body C, still has the problem of mis-alignment of the wires L11 within the connector body C1.

Further, since the wire channels of the wire holder C1 are open-ended to facilitate trimming the wires L11 to be in alignment with each other, the end portions of the wires L11 may slide out of the open ends of the channels in inserting the wire holder C1 into the interior space C3 of the connector body C. This prevents the wire holder C1 from directly abutting on the end wall of the connector body C and the slots C2 and thus the metal contacts C21 within the slots C2 may not be in correct registration with the wire channels of the wire holder C1. This prohibits the penetration of the metal contacts C21 into the wire channels to electrically connect to the wires L11.

FIG. 1B illustrates a further prior art design of the plug connector, comprising a connector body B over which a conductive casing B1, preferably made of a metal, is fit. The grounding member or wire of the cable, in this prior art design, is folded over and wrapped around the cable so that when the casing B1 is fit over the connector body B, a portion of the grounding wire is pinched and secured between the conductive casing B1 and the portion of the cable around which the grounding wire wraps.

If the force applied to the grounding wire and the cable by the conductive casing is not sufficient, the securing of the grounding wire by the conductive casing may not be sound, causing an instable contact engagement between the conductive casing and the grounding wire, such as the grounding wire may become movable relative to the conductive casing when a great axial force applied to the cable may eventually lead in disengagement of the grounding wire from the casing. On the other hand, if the grounding wire and the cable is over-secured by the conductive casing, then the twisted pairs within the cable may be squeezed and getting closer to each other, leading in deterioration of the performance of the cable.

If soldering is applied to secure the grounding wire to the conductive casing, then the cost is increased. Also, residual soldering agent may be found in the soldering locations.

In FIG. 3, a further prior art design of the plug connector is shown. This design provides a different configuration which comprises more than eight wires connected thereto. The connector comprises a connector body D with a metal casing E fit thereon. The connector body D comprises a plurality of slots D1 formed thereon within which metal contacts D2 are receive to extend into the connector body D to establish electrical connection with de-twisted wires of a cable L that is connected to the connector body D. Although this design provides a different configuration, yet the basic principle of securing and establishing electrical connection with the de-twisted wires of the cable L is the same as previously discussed prior art designs. The problems encountered by this design are the same.

It is therefore desirable to provide a connector structure wherein the de-twisted wires are pulled, rather than pushed, to the desired positioned so as to overcome the disadvantages and drawbacks of the prior art designs.

SUMMARY OF THE INVENTION

In accordance with an aspect of the present invention, there is provided a connector structure, wherein the connector comprises a body inside which an interior space is formed for receiving an end of a cable that includes a plurality of twisted wire pairs and a plurality of channels extending from the interior space to a front end face of the body to define openings on the front end face. The de-twisted portions of the wires are inserted to the channels to have an extreme end thereof extending outside the front end face. The exposed portions of the wires allow the cable to be moved more deeply into the interior space of the body by hand pulling the exposed portions. This minimizes the length of the de-twisted portions of the wires and thus reduces the cross-talking between wires.

The body is provided with an open bottom for the insertion of the cable into the body. The open bottom is defined by two opposite side walls and each of the side wall has a reduced height defined by an arc connecting segment so as to allow the operator's finger to insert therein to temporarily hold the de-twisted wires in position in mounting the wires to the connector body.

In accordance with another object of the present invention, the connector body is provided with a slot for receiving a grounding wire of the cable therein. The connector body also comprises a strip defined by an elongated opening formed thereon for receiving the grounding wire to surround thereon so that when a metal casing is securely fit over the body, the grounding wire is securely fixed on the connector body and an electrical connection is established between the grounding wire and the metal casing.

The features and advantages of the present invention will be readily understood from the following description of preferred embodiments, reference being had to the attached drawings, wherein:

BRIEF DESCRIPTION OF THE DRAWINGS

FIGS. 1A, 1B, 2(A)*a*, 2(A)*b*, 2(B)*a*, 2(B)*b* and 3 show conventional connectors of different designs;

DETAILED DESCRIPTION OF THE PREFERRED EMBODIMENTS

Figure 1A:
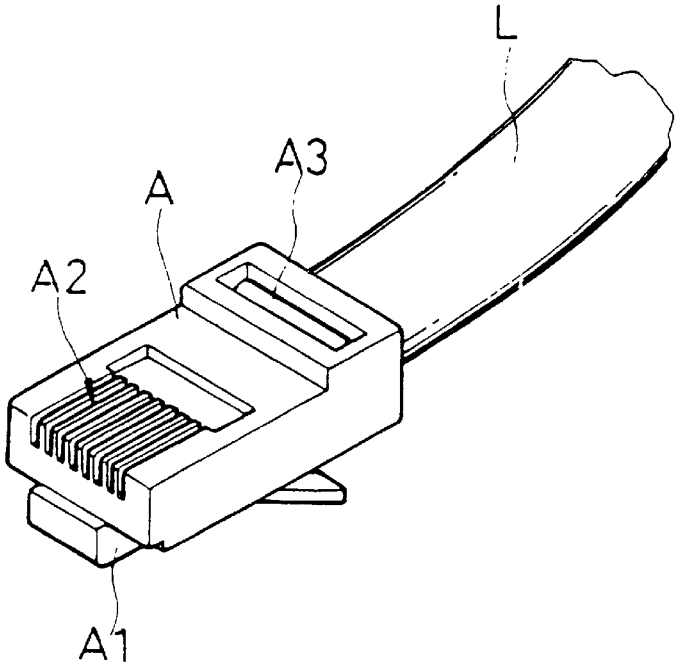
FIG.1(A) (PRIOR ART)
Figure 1B:
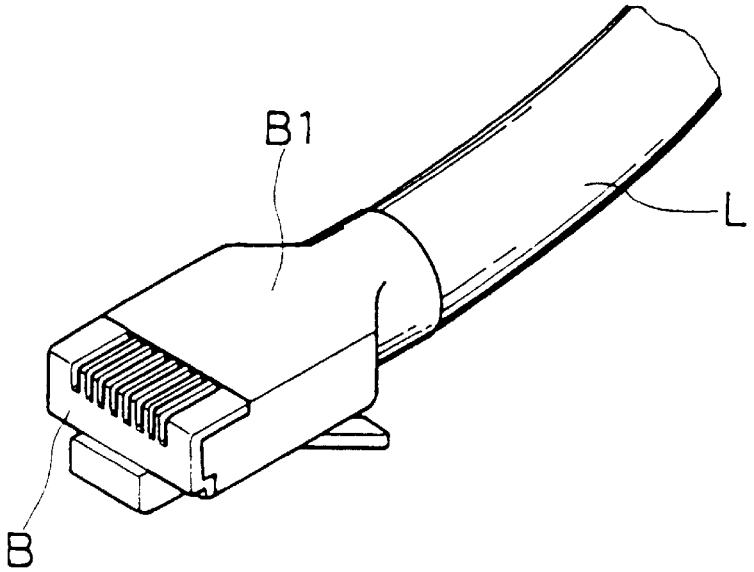
FIG.1(B) (PRIOR ART)
Figure 3:
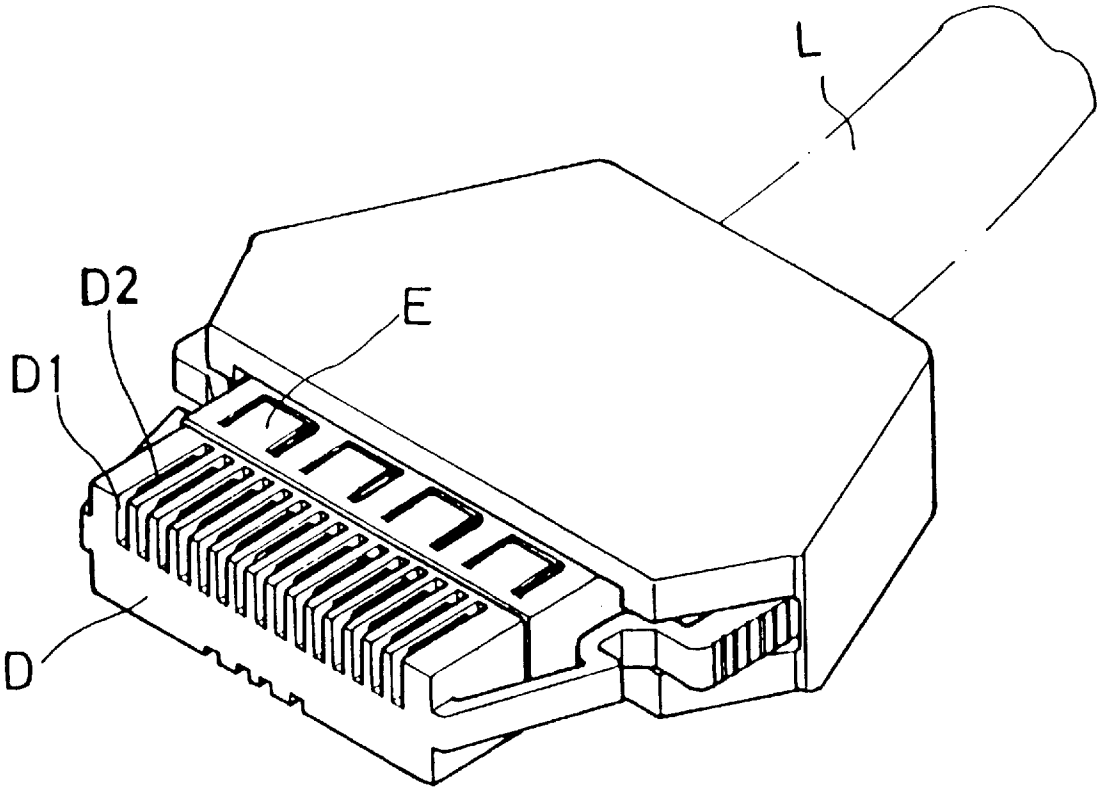
FIG. 3 (PRIOR ART)
Figure 4:
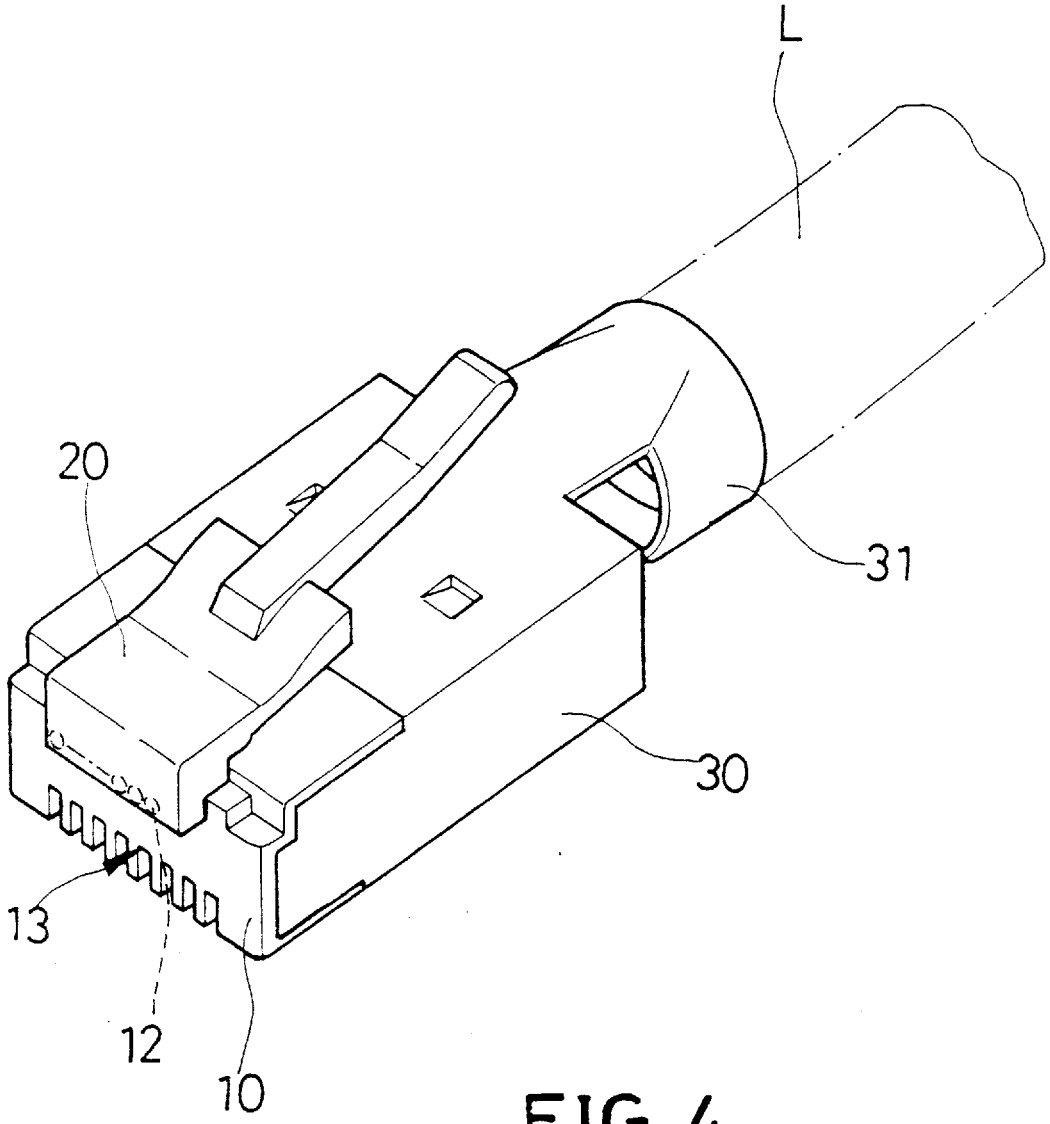
FIG. 4 is a perspective view showing a connector constructed in accordance with the present invention.
Figure 5:
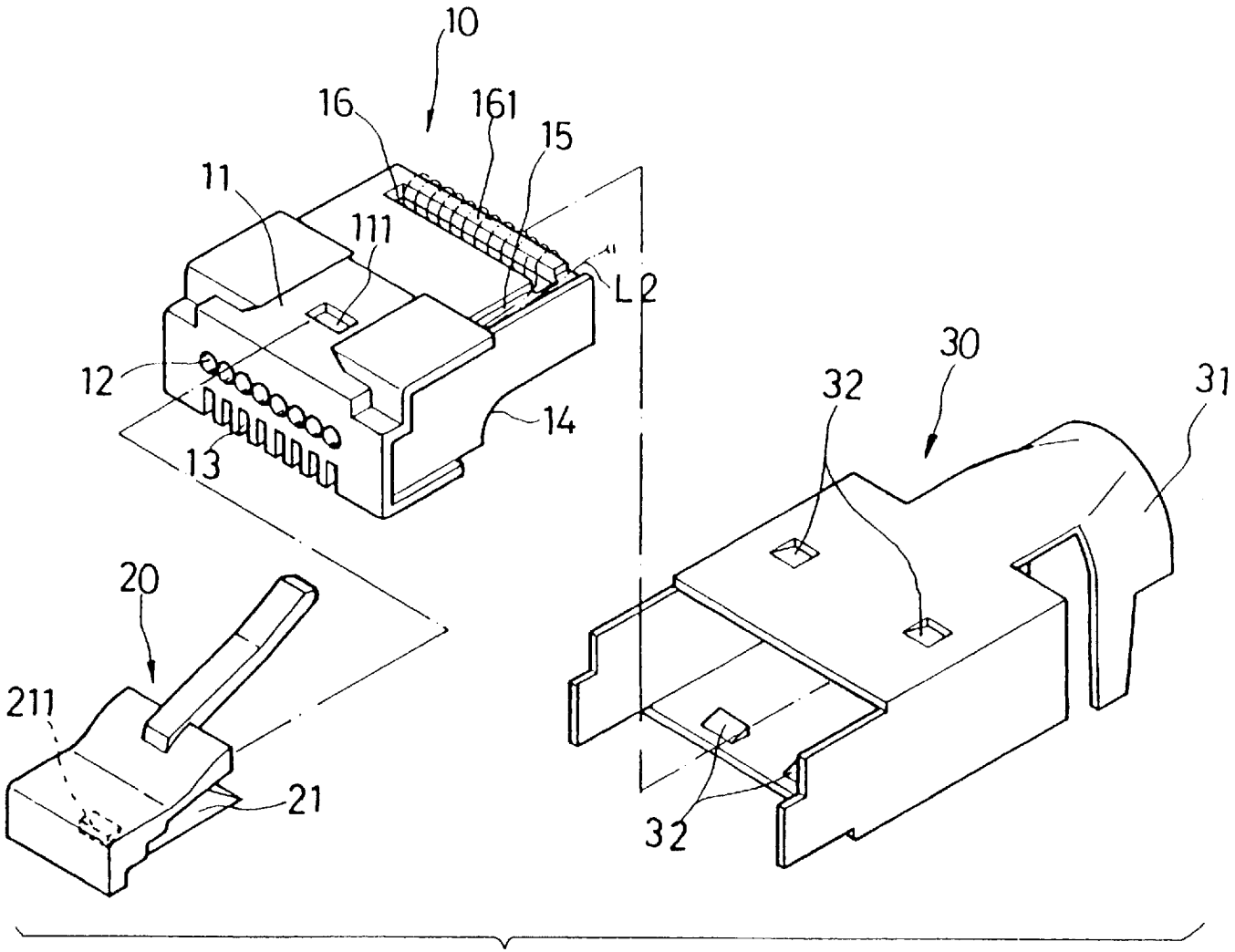
FIG. 5 is an exploded perspective view showing the connector of the present invention.
Figure 6A:
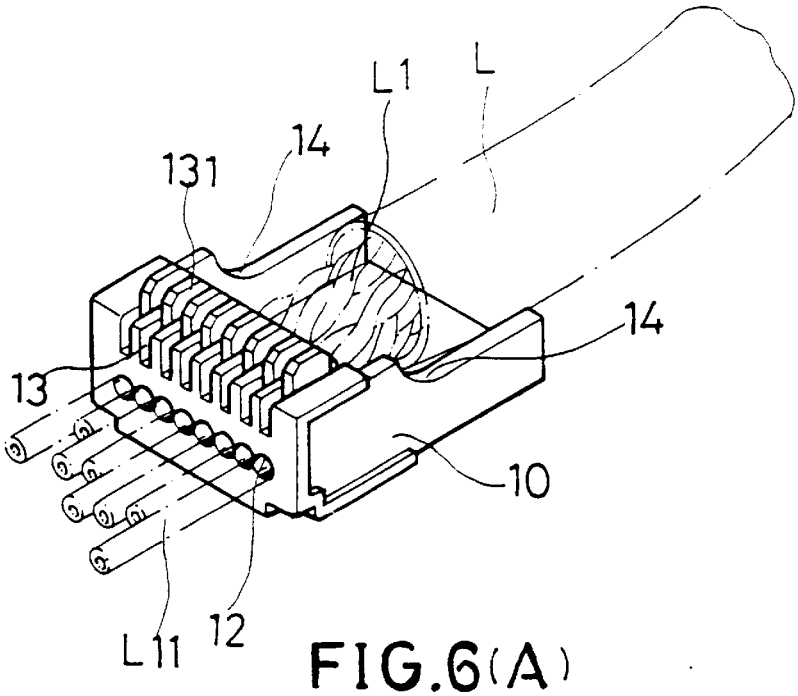
FIG. 6A is a perspective view of the connector body in an up-side-down position, showing the insertion of the wires into the connector body in accordance with the present invention.
Figure 6B:
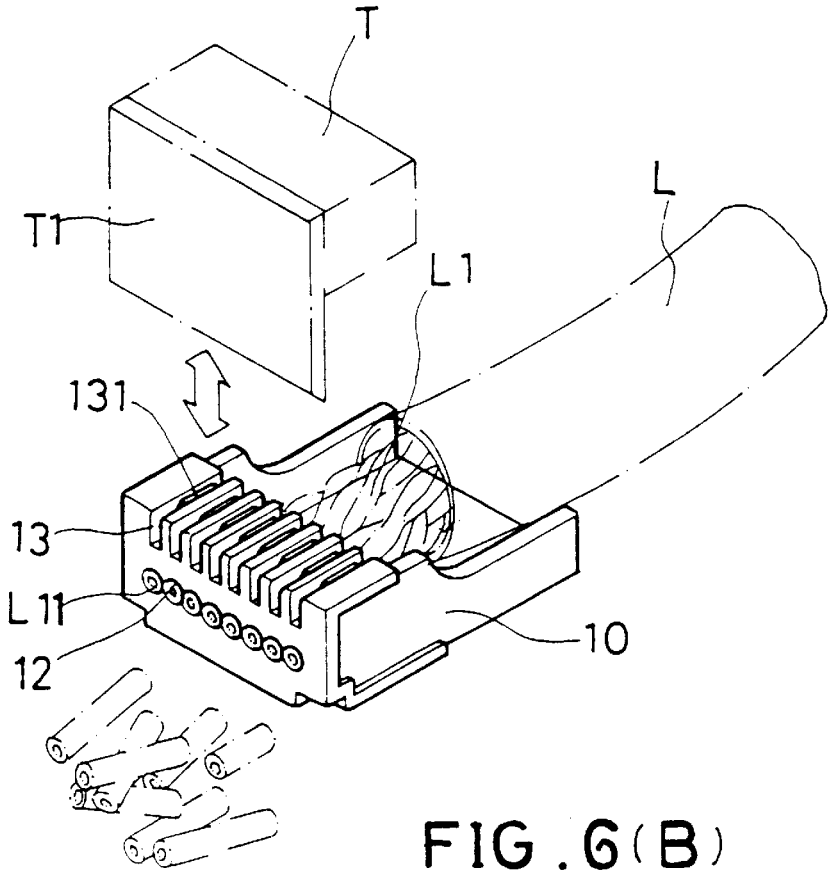
FIG. 6B is also a perspective view of the connector body in an up-side-down position, showing the trimming operation of the wires that are inserted to extend out of the connector body.

With reference to the drawings and in particular to FIGS. 4 and 5, wherein a connector constructed in accordance with the present invention is shown, the connector of the present invention comprises a body 10, a retainer 20 removably mounted to the body 10 and a metal or conductive casing 30 fit over the body 10. The body 10 is a hollow member with a closed front end face, as shown in FIGS. 6A and 6B which show the connector body 10 in an up-side-down manner with respect to the showing of FIG. 4, defining therein an interior space for receiving a number of twisted pairs of wires. In the embodiment illustrated, there are eight wires, designated with reference L11, having an insulation outer layer surrounding a conductive core and the eight wires L11 are twisted together by every two wires to form four twisted pairs which are generally designated at L1. The four twisted pairs L1 are enclosed within an insulation enclosure to define a cable L.

The connector body 10 comprises a plurality of juxtaposing wire channels 12 extending from the interior space of the connector body 10 to the front end face to define openings on the front end face. The wire channels 12 receive the wires L11 to extend therethrough and have a portion thereof exposed outside the front end face. Thus, the wire channels 12 are open-ended passages and allow the wires L11 to extend out of the connector body 10 through the open ends of the wires channels 12.

The connector body 10 further comprises a plurality of slots 13 formed thereon, located above and associated with the wire channels 12 to be in communication with the associated wire channel 12. Each of the slots 13 receives and holds therein a metal contact 131. The metal contacts 131 have piercing means (not shown) located to be confronting the wires L11 that are received within the wire channels 12, so that when a tool T is used to press the metal contacts 131 that are originally partially protruding out of the slots 13 to force the metal contacts 131 to move toward the wires L11, the piercing means penetrates into the wires L11 to establish electrical connection with the wires L11. The penetration of the metal contacts 131 into the wires L11 also serves to hold the wires L11 in position within the connector body 10.

The retainer 20, as more clearly shown in FIG. 5, is removably fix to the connector body 10 to (1) shield the open ends of the wire channels 12 and the wires L11 within the wire channels 12 and (2) to releasably connect the plug connector to a corresponding socket connector (not shown). To fix the retainer 20 to the connector body 10, the connector body 10 is provided with a receiving slots 11 to receive and hold a base 21 of the retainer 20. Preferably and as shown in FIG. 5, the base 21 of the retainer 20 is made in the form of a dovetail and the receiving slot 11 of the connector body 10 forms a dovetail groove.

To secure the correct position of the retainer 20 relative to the connector body 10, the base 21 of the retainer 20 is provided with a raised boss 211 to be receivable within a recess 111 formed on the receiving slot 11 of the connector body 10. The boss 211 is dimensioned so that the dovetail-like base 21 of the retainer 20 is forcibly insertable into the dovetail groove 11 of the connector body 10 to allow the boss 211 to move to and enter the recess 111 of the connector body 10.

Preferably, the connector body 10 has an open bottom side, as shown in FIGS. 6A and 6B, defined by two opposite side walls to facilitate the positioning of the cable L into the interior space of the connector body 10. Even preferably, the side walls that define the open bottom of the connector body 10 has a reduced height defined by arc connecting segments 14 to further facilitate the insertion of the cable L into the connector body 10.

The connector body 10 has a closed top side on which a grounding wire slot 15 is provided for receiving a grounding wire L2 of the cable L (FIG. 5) therein. This provides a space for more snugly handling the portion of the grounding wire L2 of the cable L corresponding to the de-twisted portions of the wire pairs L1. By fitting the metal casing 30 over the connector body 10, an electrical connection may be established between the grounding wire L2 and the metal casing 30.

The metal casing 30 comprises two side walls adapted to contact grounding members of the corresponding socket connector so as to establish an electrical connection between the grounding wire L2 of the cable L and that of the socket connector. Preferably, the metal casing 30 is provided with a strain relief ring 31 which is capable to surround and fix to the cable L by applying external force thereon. This strain relief ring 31 helps to secure the metal casing 30 on the cable L.

The top side of the connector body 10 may be additionally provided with a strip 161 which is formed by providing an elongated opening 16 on the top side of the connector body 10. The opening and strip configuration allows the grounding wire L2 to wrap around the strip 161 so that when the metal casing 30 is fit over the connector body 10, a more secure contact engagement is formed between the portion of the grounding wire L2 wrapping the strip 161 and the metal casing 30.

Preferably, the metal casing 30 is provided with inward-indented sections 32 which are capable to fit into the elongated opening 16 for securely retaining the metal casing 30 on the connector body 10. Preferably, the indented sections 32 are provided with inclined camming faces to help moving the indented sections 32 into the opening 16.

Figure 7:
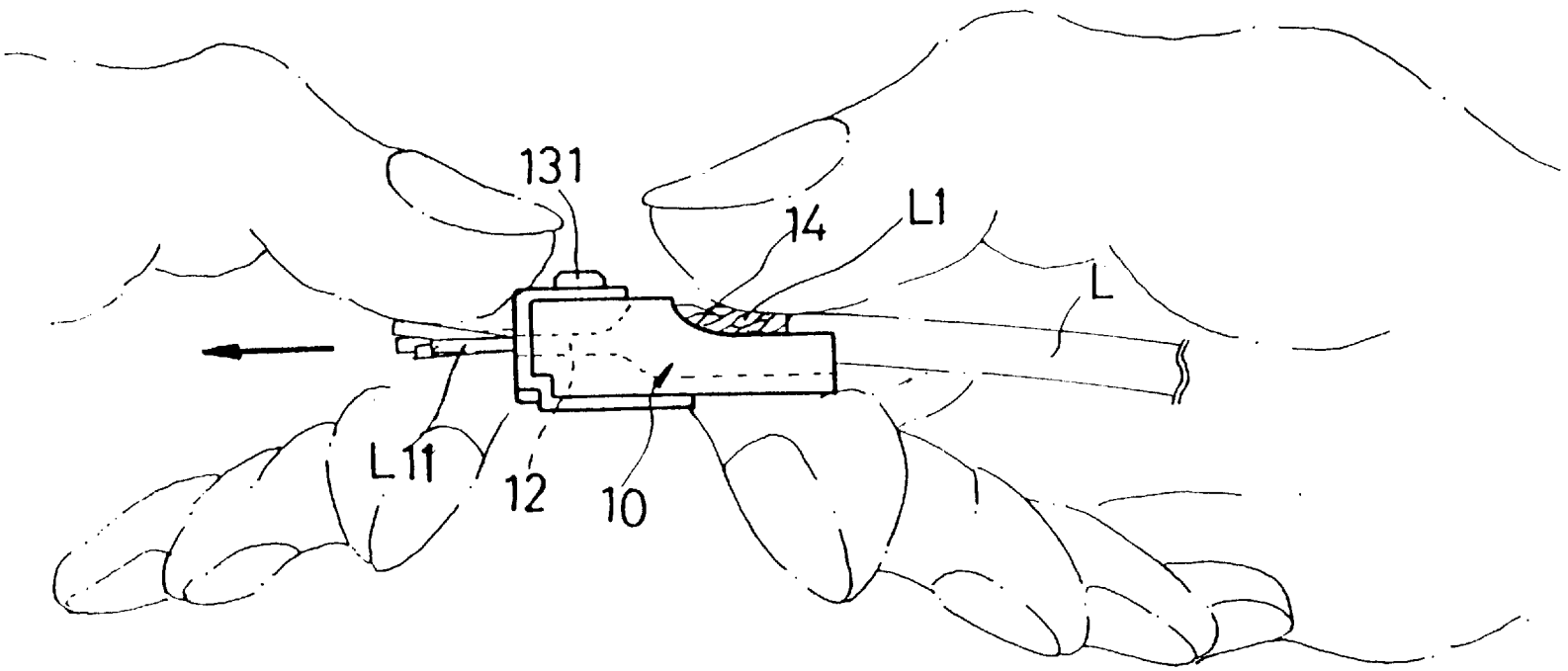
FIG. 7 shows the manual operation of mounting the wires to the connector in accordance with the present invention.

FIGS. 6A, 6B and 7 show the way to mount a cable L to the connector in accordance with the present invention. As shown in FIG. 6A, the de-twisted wires L11 are first inserted into the wire channels 12 to such a location where all wires have end portions extending out of the connector body 10. Thereafter, the operator may manually pull the exposed end portions of the wires L11 to have the wires L11 go further into the wire channels 12, as shown in FIG. 7. In this respect, the open bottom side and the arc connecting segments 14 allow the operator's finger to fully contact the cable L and the twisted wire pairs L1 for firmly holding and handling them. The operator may pull the de-twisted wires L11 to such an extent that the un-de-twisted portions of the twisted pairs L1 may securely abut against the inner ends of the wire channels 12. This helps reducing the overall length of the de-twisted portions of the wires L11 so as to decease the "cross-talking" between the de-twisted portions of the wires L11.

The operator may then use the tool T to force the metal contacts 131 that are located within the slots 13 to pierce into and thus establish electrical connection with and securely hold the de-twisted wires L11 that are located within the wire channels 12.

Preferably, the tool T is provided with a trimmer blade T1 which may slide along the front end face of the connector body 10 when the tool T is operated to force the metal contacts 131 deeply into the slots 13 to piece into the wires L11. The trimmer blade T1 cuts off the portion of the wires L11 that are exposed outside the front end face of the connector body 10 and thus aligns the ends of the wires with the front end face of the connector body 10, as shown in FIG. 6B.

Figure 8:
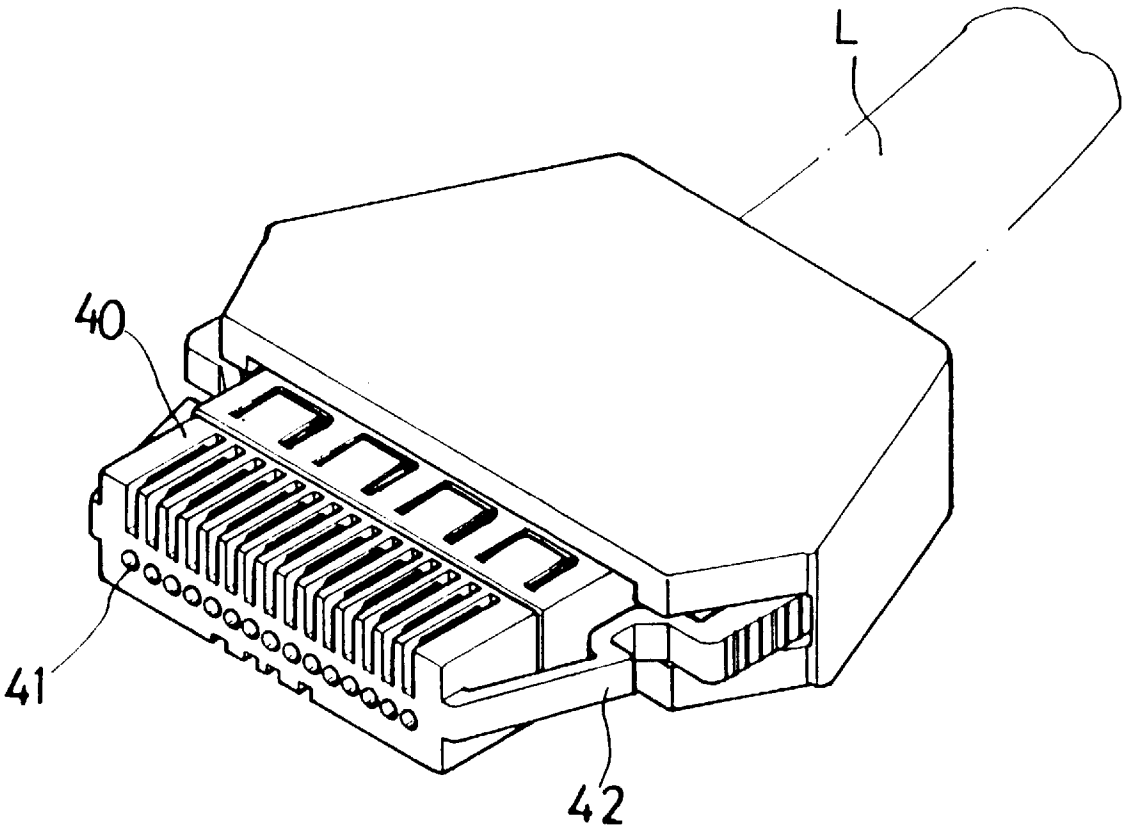
FIG. 8 is a perspective view showing another embodiment of the connector structure in accordance with the present invention.

In FIG. 8, another embodiment of the present invention is shown. The embodiment shown in FIG. 8 comprises a different configuration from that of the first embodiment, yet they adapts the same principle, namely providing open-ended wire channels to allow the de-twisted wires to extend therethrough so that an operator may manually pull, rather than push, the wires to the desired location. The second embodiment comprises a connector body 40 within which a plurality of wire channels 41 are formed, which are open at the front end face of the connector body 40 to allow the wires de-twisted from twisted pairs of a cable L to completely extend therethrough. In the configuration of the second embodiment, the connector body 40 comprises retainers 42 which are located at two opposite sides thereof and thus not blocking the extension of the wires through the wire channels 41 so that the retainers 42 may be integrally formed with the connector body 40. No releasable engagement between the retainer and the connector body is needed in this embodiment which is different from the first embodiment.

Figure 9:
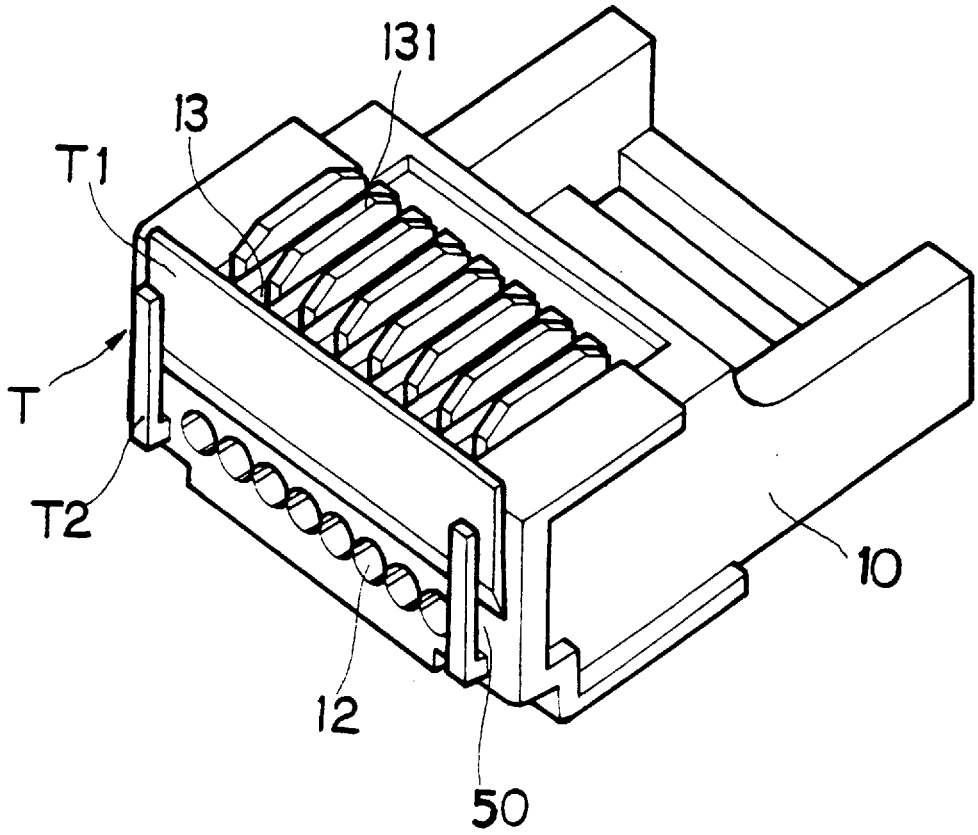
FIG. 9 is a perspective view showing a further embodiment, wherein the tool is slidably supported on the connector body.

Referring to FIG. 9 which shows a further embodiment of the present invention, the connector body 50 of the specific embodiment is equipped with an integral tool T, which contrary to the embodiment shown in FIG. 6B is not separate from the connector body 10 and instead, is slidably supported on two guides T2 that are provided on a front end face of the connector body 10 and spaced from the front end face to define therebetween a gap 50 for slidably receiving therein a trimmer blade T1 of the tool T therein. In operation, the trimmer blade T1 is originally located within the gap 50 and above the openings of the wire channels 12 so that when the wires L11 are inserted into the wire channels 12 with end portions thereof extending outside the channels 12 from the front end face of the connector body 10, the trimmer blade T1 is forced downward under the guidance of the guides T2 to cut off the exposed end portions of the wires L11. The guides T2 are configured so that the downward movement of the trimmer blade T1 also breaks the connection between the guides T2 and the connector body 10. This is similar to the trimming operation illustrated in FIG. 6B, but the tool T is provided on the connector body 10 and the block of the tool T to force the metal contacts 131 to pierce into the wire L11 is eliminated to allow the trimmer blade T1 to completely move along the front end face of the connector body 10 to break the guides T2. This makes the trimming operation more convenient.

In mounting the cable to the connector, the wires are inserted through the wire channels and then pulled by the operator' hand. The exposed portions of the wires are not cut off until the metal contacts are forced to pierce into the portions of the wires that are located within the wire channels. This simplifies the mounting operation of the wires to the connector and no skilled operation is needed in making non-flaw product. The ends of the trimmed wires are in excellent alignment with each other and the front end face of the connector body. Further, the design in accordance with the present invention minimizes the length of the de-twisted portions of the wires and thus lowers down the cross-talking between the de-twisted wires. In addition, the present invention provides a connector design which includes a grounding wire slot for receiving the grounding wire of the cable and a grounding wire holding strip to receive the grounding wire to surround thereon so that when the metal casing is fit over the connector body, the grounding wire can be securely held therebetween and a good electrical connection is established between the metal casing and the grounding wire.

The above description is made with respect to the preferred embodiments of the present invention and for those skilled in the art, it is possible to made a variety of modifications and changes to the above-described embodiments without departing from the scope and spirit of the present invention. All these modifications and changes should be considered within the scope of the present invention as defined in the appended claims.

What is claimed is:

1. A connector structure comprising a connector body over which a conductive casing is securely fit, the connector body comprising a hollow member defining therein an interior space adapted to receive an end portion of a cable which comprises a plurality of twisted pairs of wires, the connector body having a plurality of wire channels corresponding to the wires de-twisted from the twisted pairs of the wires and adapted to receive the de-twisted portions of the wires extending therethrough, the wire channels defining openings on a front end face of the connector body so as to allow the de-twisted portions of the wires to extend through the wire channel and thus exposed through the openings so as to allow an operator to pull the exposed portions of the wires for facilitating moving the wires into the connector body to a desired extent, the connector body further comprising a plurality of slots formed thereon and located above the wire channels to be in communication therewith for receiving and holding therein metal contacts which are adapted to penetrate through insulation layers of the de-twisted wires to hold the wires in position within the wire channels and to physically contact conductive cores of the wires for establishing electrical connection therewith, wherein the connector body comprises a grounding wire holding strip defined by an elongated opening formed on the connector body, the strip being adapted to receive a grounding wire of the cable to surround thereon so that with a metal casing fit over the connector body, the grounding wire is securely held between the connector body and the metal casing and an electrical connection is established between the grounding wire and the metal casing.

2. The connector structure as claimed in claim 1, wherein the conductive casing comprises a front opening for fitting over the connector body and a rear end having a strain relief ring to secure to the cable for more securely holding the cable to the connector body.

3. The connector structure as claimed in claim 1, wherein the connector body is provided with a grounding wire slot adapted to receive therein a grounding wire of the cable.

4. The connector structure as claimed in claim 1, wherein the metal casing comprises inward indented sections to be received within the opening to securely hold the metal casing on the connector body.

5. A connector structure as claimed in claim 1, wherein the connector body is configured so that a tool is operable to force the metal contacts to pierce into the wires and at the same time, a trimmer blade of the tool slides along the front end face of the connector body to cut off the exposed portions of the wires.

6. The connector structure as claimed in claim 1, wherein the connector body comprises an open bottom side to facilitate inserting the de-twisted portions of the wires into the wire channels.

7. The connector structure as claimed in claim 6, wherein the open bottom side of the connector body is defined by two opposite sides and wherein the side walls have a reduced height defined by an arc connecting segment for finger access to the interior space of the connector body.

8. A connector structure comprising a connector body over which a conductive casing is securely fit, the connector body comprising a hollow member defining therein an interior space adapted to receive an end portion of a cable which comprises a plurality of twisted pairs of wires, the connector body having a plurality of wire channels corresponding to the wires de-twisted from the twisted pairs of the wires and adapted to receive the de-twisted portions of the wires extending therethrough, the wire channels defining openings on a front end face of the connector body so as to allow the de-twisted portions of the wires to extend through the wire channel and thus exposed through the openings so as to allow an operator to pull the exposed portions of the wires for facilitating moving the wires into the connector body to a desired extent, the connector body further comprising a plurality of slots formed thereon and located above the wire channels to be in communication therewith for receiving and holding therein metal contacts which are adapted to penetrate through insulation layers of the de-twisted wires to hold the wires in position within the wire channels and to physically contact conductive cores of the wires for establishing electrical connection therewith, the connector structure further comprising a retainer removably attached to the connector body adapted to retain the connector to a counterpart connector the retainer being attached to the connector body after the exposed portions of the wires are cut off and being so configured to shield the openings of the wire channel.

9. The connector structure as claimed in claim 8, wherein the connector body comprises a dovetail groove formed thereon and the retainer comprises a dovetail-shaped base to be fit into the dovetail groove of the connector body.

10. The connector structure as claimed in claim 9, wherein the dovetail-shaped base of the retainer comprises a raised boss to be received within a recess formed in the dovetail groove of the connector body for holding the retainer in position on the connector body.

* * * * *